US009801418B1

(12) United States Patent
Liu

(10) Patent No.: US 9,801,418 B1
(45) Date of Patent: Oct. 31, 2017

(54) ELECTRONIC CIGARETTE

(71) Applicant: Tuanfang Liu, Ji'an (CN)

(72) Inventor: Tuanfang Liu, Ji'an (CN)

( * ) Notice: Subject to any disclaimer, the term of this patent is extended or adjusted under 35 U.S.C. 154(b) by 0 days.

(21) Appl. No.: 15/259,004

(22) Filed: Sep. 7, 2016

(30) Foreign Application Priority Data

Apr. 27, 2016 (CN) ..... 2016 1 0271009
Apr. 27, 2016 (CN) ..... 2016 2 0368880 U

(51) Int. Cl.
*A24F 47/00* (2006.01)
*A24F 7/00* (2006.01)

(52) U.S. Cl.
CPC ..... *A24F 47/008* (2013.01); *A24F 7/00* (2013.01)

(58) Field of Classification Search
CPC ..... A24F 47/008; A24F 7/00
USPC ..... 131/329
See application file for complete search history.

(56) References Cited

U.S. PATENT DOCUMENTS

| | | | | |
|---|---|---|---|---|
| 9,226,526 | B2 * | 1/2016 | Liu | A24F 47/008 |
| 9,497,996 | B2 * | 11/2016 | Liu | A24F 47/008 |
| 9,609,893 | B2 * | 4/2017 | Novak, III | A24F 47/008 |
| 2014/0130797 | A1 * | 5/2014 | Liu | A24F 47/008 128/202.21 |
| 2014/0311503 | A1 * | 10/2014 | Liu | G02B 27/18 131/329 |

* cited by examiner

*Primary Examiner* — Tulsidas C Patel
*Assistant Examiner* — Travis Chambers
(74) *Attorney, Agent, or Firm* — Matthias Scholl, PC; Matthias Scholl

(57) ABSTRACT

An electronic cigarette, including an atomizer assembly and a battery assembly. The atomizer assembly includes a silicon mouthpiece, a mouthpiece base, a first sealing ring of the mouthpiece base, a second sealing ring, a glass tube, a shell, a third sealing ring of the shell, a limit cover, a piece of cotton, a pair of transverse heating wires, a heating wire base, a first insulating ring, and a connector. The battery assembly includes a battery connector, a second insulating ring, a button base, a regulation ring, a fourth sealing ring, a carrier, a circuit board, a fixing ring of the circuit board, a steel tube, a button, an electrical core, an anode, an insulating cap, and an electrode base. The atomizer assembly is disposed on the battery assembly, and is in a threaded connection to the battery assembly.

2 Claims, 5 Drawing Sheets

ELECTRONIC CIGARETTE

CROSS-REFERENCE TO RELATED APPLICATIONS

Pursuant to 35 U.S.C. §119 and the Paris Convention Treaty, this application claims the benefit of Chinese Patent Application No. 201610271009.5 filed Apr. 27, 2016, and Chinese Patent Application No. 201620368880.2 filed Apr. 27, 2016, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The invention relates to an electronic cigarette.

Description of the Related Art

Conventionally, the mouthpiece and the shell of an electronic cigarette are plastic. The plastic tends to react with tobacco tar and produce harmful substances. In addition, the air flow through a conventional electronic cigarette is non-adjustable and thus does not meet the requirements of different users.

SUMMARY OF THE INVENTION

In view of the above-described problems, it is one objective of the invention to provide an electronic cigarette the airflow through which can be adjusted, which is made of safe and environmentally-friendly materials, and which is convenient to carry around.

To achieve the above objective, in accordance with one embodiment of the invention, there is provided an electronic cigarette, comprising an atomizer assembly and a battery assembly. The atomizer assembly comprises a silicon mouthpiece, a mouthpiece base, a first sealing ring of mouthpiece base, a second sealing ring, a glass tube, a shell, a third sealing ring of shell, a limit cover, a piece of cotton, a pair of transverse heating wires, a heating wire base, a first insulating ring, and a connector. The battery assembly comprises a battery connector, a second insulating ring, a button base, a regulation ring, a fourth sealing ring, a carrier, a circuit board, a fixing ring of circuit board, a steel tube, a button, an electrical core, an anode, an insulating cap, and an electrode base. The atomizer assembly is disposed on the battery assembly, and is in a threaded connection to the battery assembly. The silicon mouthpiece is disposed on the mouthpiece base. The first sealing ring is disposed on a slot of the mouthpiece base. Then the second sealing ring and the glass tube are adapted to seal the silicon mouthpiece. The mouthpiece base is in a threaded connection to the limit cover. During an oil addition, the mouthpiece base is twisted up so as to add oil in the glass tube which is an oil reservoir. A pair of transverse heating wires are disposed on a bottom of the atomizer assembly. The transverse heating wires are disposed on the heating wire base. A first insulating ring and a connector are disposed on a bottom of the heating wire base. A piece of cotton and the limit cover are sleeved on and compressed on the heating wire base, then the shell is sleeved on the heating wire base. The third sealing ring is sleeved on the shell. The electronic cigarette having an outer diameter of 10 mm features low resistance, large amount of smoke, and favorable taste.

Preferably, the second insulating ring is disposed on a bottom of the button base, and the fourth sealing ring is sleeved on the button base. Then the regulation ring and the carrier are compressed on the button base. The battery connector is disposed on the bottom of the button base. A positive wire of the circuit board is soldered to the battery connector and is fixed using glue in case of falling off. The circuit board is secured to slots on both sides of the carrier and is soldered to the carrier. The fixing ring of circuit board is sleeved on the circuit board. The positive wire and a negative wire of the circuit board are soldered to an anode and a cathode of the electrical core. The circuit board is sheathed in the steel tube. A connecting wire of the circuit board is soldered to the anode. The insulating cap is compressed on the electrode base. The button is disposed on the steel tube. The regulation ring of the battery assembly is adapted to control the air inlet during smoking process, thereby satisfying different requirements for tastes. A bottom part of the electronic cigarette is provided with a charging structure using magnets, facilitating the charging. Because the atomizer assembly uses the silicon mouthpiece, and the glass tube employs the tube material having the outer diameter of 10 mm, the electronic cigarette becomes small-sized and convenient for carrying, thereby improving customer experience.

Advantages of the electronic cigarette according to embodiments of the invention are summarized as follows:

The electronic cigarette is charged using a magnetic charging method, thus the electronic cigarette is convenient to use, and the air flow thereof is adjustable.

BRIEF DESCRIPTION OF THE DRAWINGS

The invention is described hereinbelow with reference to the accompanying drawings.

DETAILED DESCRIPTION OF THE EMBODIMENTS

For further illustrating the invention, experiments detailing an electronic cigarette are described below. It should be noted that the following examples are intended to describe and not to limit the invention.

Figure 1:
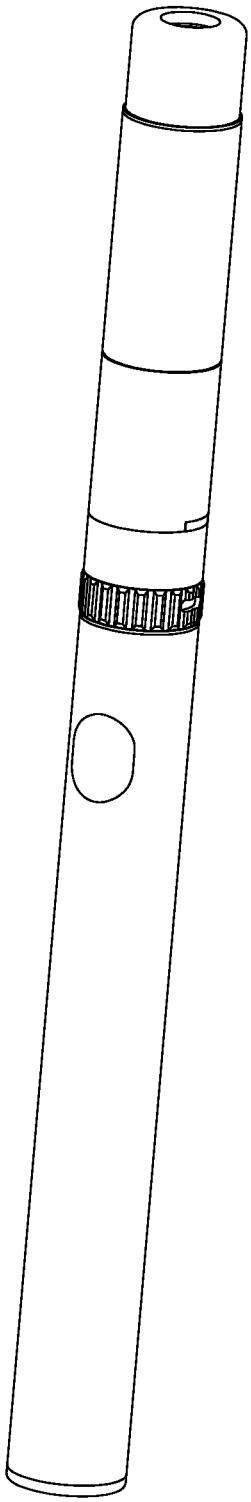
FIG. 1 is a stereogram of an electronic cigarette in accordance with one embodiment of the invention.
Figure 2:
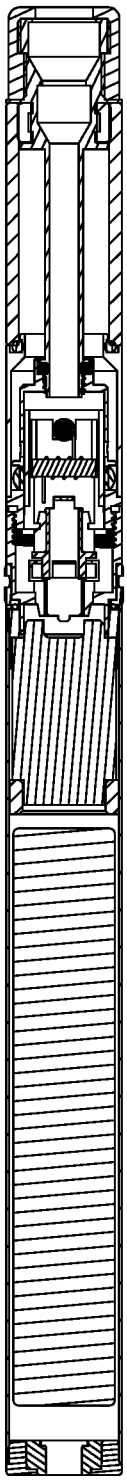
FIG. 2 is a cross-sectional diagram of an electronic cigarette in accordance with one embodiment of the invention.
Figure 3A:
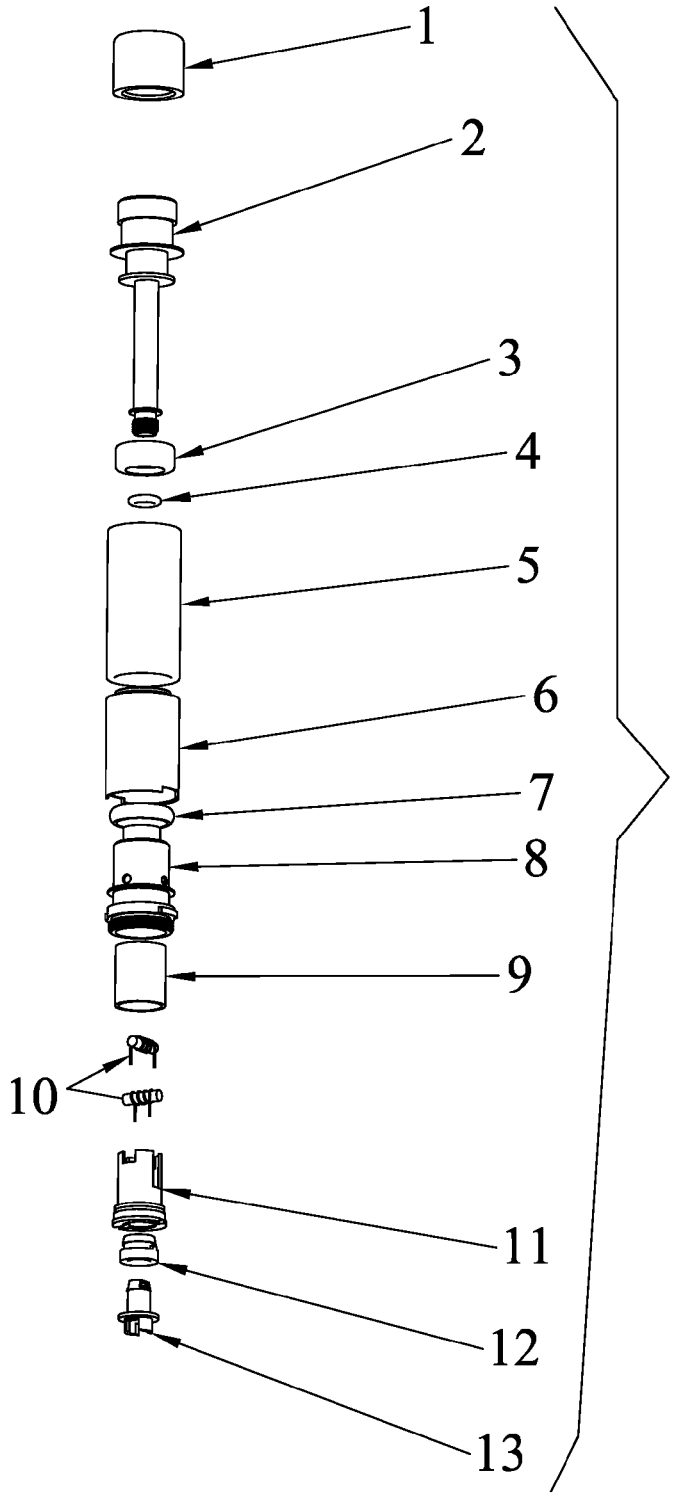
FIGS. 3A-3B are exploded views showing an assembly of an electronic cigarette in accordance with one embodiment of the invention.
Figure 3B:
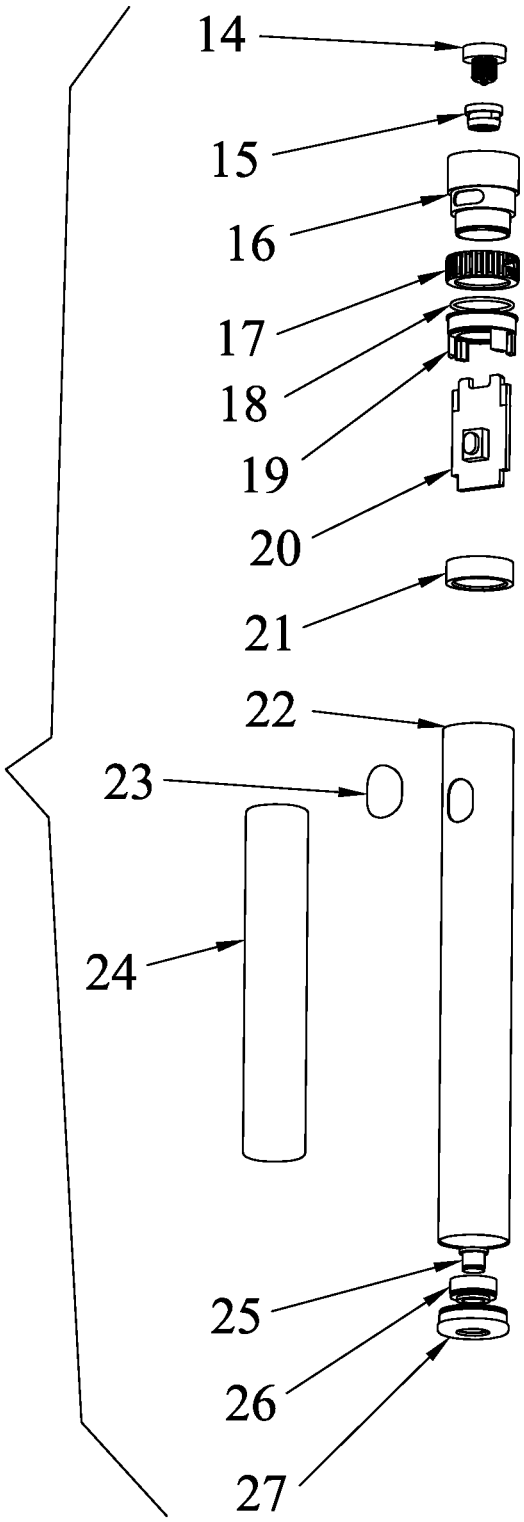
Figure 4:
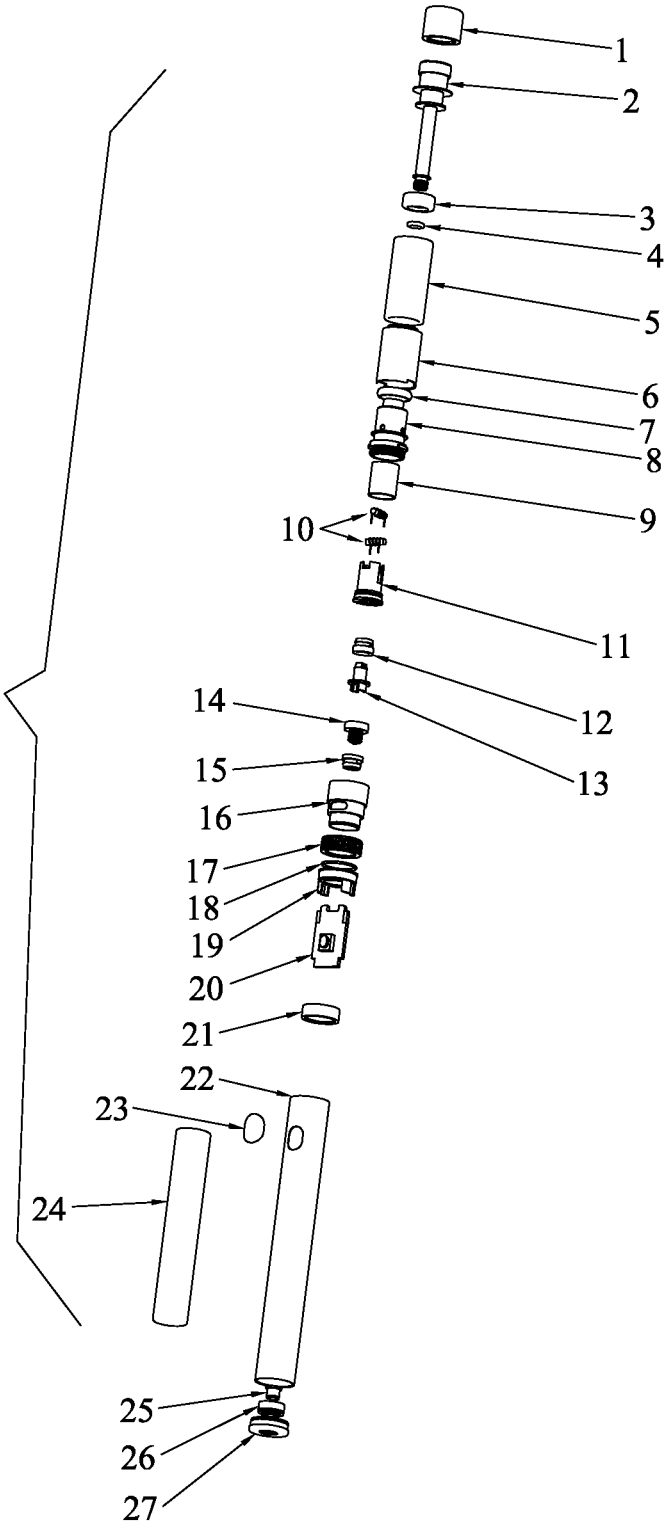
FIG. 4 is an exploded view of an electronic cigarette in accordance with one embodiment of the invention.

As show in FIGS. 1, 2, 3A, 3B, and 4, an electronic cigarette comprises an atomizer assembly in FIG. 3A and a battery assembly in FIG. 3B. The atomizer assembly in FIG. 3A comprises a silicon mouthpiece 1, a mouthpiece base 2, a first sealing ring 3 of mouthpiece base, a second sealing ring 4, a glass tube 5, a shell 6, a third sealing ring 7 of shell, a limit cover 8, a piece of cotton 9, a pair of transverse heating wires 10, a heating wire base 11, a first insulating ring 12, and a connector 13. The battery assembly in FIG. 3B comprises a battery connector 14, a second insulating ring 15, a button base 16, a regulation ring 17, a fourth sealing ring 18, a carrier 19, a circuit board 20, a fixing ring 21 of circuit board, a steel tube 22, a button 23, an electrical core 24, an anode 25, an insulating cap 26, and an electrode base 27. The atomizer assembly in FIG. 3A is disposed on the battery assembly in FIG. 3B, and is in a threaded connection to the battery assembly in FIG. 3B. The silicon mouthpiece 1 is disposed on the mouthpiece base 2. The first sealing ring 3 is disposed on a slot of the mouthpiece base 2. Then the second sealing ring 4 and the glass tube 5 are adapted to seal the silicon mouthpiece 1. The mouthpiece base 2 is in a threaded connection to the limit cover 8. During the oil addition, the mouthpiece base 2 is twisted up so as to add oil in the glass tube 5 which is the oil reservoir. A pair of transverse heating wires 10 are disposed on a bottom of the atomizer assembly in FIG. 3A. The transverse heating wires 10 are disposed on the heating wire base 11. A first insulating ring 12 and a connector 13 are disposed on a bottom of the heating wire base 11. A piece of cotton 9 and the limit cover 8 are sleeved on and compressed on the heating wire base 11, then the shell 6 is sleeved on the heating wire base 11. The third sealing ring 7 is sleeved on the shell 6. The electronic cigarette having an outer diameter of 10 mm features low resistance, large amount of smoke, and favorable taste.

Preferably, the second insulating ring 15 is disposed on a bottom of the button base 16, and the fourth sealing ring is sleeved on the button base. Then the regulation ring 17 and the carrier 19 are compressed on the button base 16. The battery connector 14 is disposed on the bottom of the button base 16. A positive wire of the circuit board 20 is soldered to the battery connector 14 and is fixed using glue in case of falling off. The circuit board 20 is secured to slots on both sides of the carrier 19 and is soldered to the carrier 19. The fixing ring 21 of circuit board is sleeved on the circuit board 20. The positive wire and a negative wire of the circuit board are soldered to an anode and a cathode of the electrical core 24. The circuit board is sheathed in the steel tube 22. A connecting wire of the circuit board 20 is soldered to the anode 25. The insulating cap 26 is compressed on the electrode base 27. The button 23 is disposed on the steel tube. The regulation ring 17 of the battery assembly in FIG. 3B is adapted to control the air inlet during smoking process, thereby satisfying different requirements for tastes. A bottom part of the electronic cigarette is provided with a charging structure using magnets, facilitating the charging. Because the atomizer assembly in FIG. 3A uses the silicon mouthpiece 1, and the glass tube 5 employs the tube material having the outer diameter of 10 mm, the electronic cigarette becomes small-sized and convenient for carrying, thereby improving customer experience.

The electronic cigarette is charged using a magnetic charging method, thus the electronic cigarette is convenient to use, and problems of conventional plug-pull charging method are solved, thereby facilitating the charging.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An electronic cigarette, comprising:

an atomizer assembly; the atomizer assembly comprising a silicon mouthpiece, a mouthpiece base, a first sealing ring, a second sealing ring, a glass tube, a shell, a third sealing ring, a limit cover, a piece of cotton, a pair of transverse heating wires, a heating wire base, a first insulating ring, and a connector; and a battery assembly; the battery assembly comprising a battery connector, a second insulating ring, a button base, a regulation ring, a fourth sealing ring, a carrier, a circuit board, a fixing ring of the circuit board, a steel tube, a button, an electrical core, an anode, an insulating cap, and an electrode base;

wherein the atomizer assembly is disposed on the battery assembly, and is in a threaded connection to the battery assembly;

the silicon mouthpiece is disposed on the mouthpiece base; the first sealing ring is disposed on a slot of the mouthpiece base; the second sealing ring and the glass tube are combined to seal the silicon mouthpiece; the mouthpiece base is in a threaded connection to the limit cover; a pair of transverse heating wires is disposed on a bottom of the atomizer assembly; the transverse heating wires are disposed on the heating wire base; and the first insulating ring and a connector are disposed on a bottom of the heating wire base; a piece of cotton and the limit cover are sleeved on and compressed on the heating wire base, then the shell is sleeved on the heating wire base; the third sealing ring is sleeved on the shell.

2. The electronic cigarette of claim 1, wherein the second insulating ring is disposed on a bottom of the button base, and the fourth sealing ring is sleeved on the button base; then the regulation ring and the carrier are compressed on the button base;

the battery connector is disposed on the bottom of the button base;

a positive wire of the circuit board is soldered to the battery connector and is fixed using glue; the circuit board is secured to slots on both sides of the carrier and is soldered to the carrier; the fixing ring of the circuit board is sleeved on the circuit board; the positive wire and a negative wire of the circuit board are soldered to an anode and a cathode of the electrical core; the circuit board is sheathed in the steel tube; a connecting wire of the circuit board is soldered to the anode; the insulating cap is compressed on the electrode base; and the button is disposed on the steel tube; the regulation ring of the battery assembly is adapted to control the air inlet; a bottom part of the electronic cigarette is provided with a charging structure using magnets; the glass tube employs tube materials having an outer diameter of 10 mm.

* * * * *